US009564076B2

(12) United States Patent
Syu

(10) Patent No.: US 9,564,076 B2
(45) Date of Patent: Feb. 7, 2017

(54) ARRAY SUBSTRATE, DISPLAY APPARATUS AND DRIVING METHOD THEREOF

(71) Applicant: Shenzhen China Star Optoelectronics Technology Co., Ltd., Shenzhen, Guangdong (CN)

(72) Inventor: Shen-sian Syu, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 198 days.

(21) Appl. No.: 14/408,674

(22) PCT Filed: Nov. 17, 2014

(86) PCT No.: PCT/CN2014/091253
§ 371 (c)(1),
(2) Date: Dec. 17, 2014

(87) PCT Pub. No.: WO2016/074251
PCT Pub. Date: May 19, 2016

(65) Prior Publication Data

US 2016/0275840 A1 Sep. 22, 2016

(30) Foreign Application Priority Data

Nov. 11, 2014 (CN) ..... 2014 1 0632904

(51) Int. Cl.
*G09G 3/20* (2006.01)
*G09G 3/36* (2006.01)

(52) U.S. Cl.
CPC ..... *G09G 3/2003* (2013.01); *G09G 3/36* (2013.01); *G09G 3/3688* (2013.01); *G09G 2310/027* (2013.01); *G09G 2320/0673* (2013.01)

(58) Field of Classification Search
CPC ..... G09G 3/3233; G09G 3/3241; G09G 3/22; G09G 3/2801; G09G 2310/0251; G09G 2300/0842; G09G 3/3688; G09G 3/3677; G02F 1/133603; H05B 37/02
See application file for complete search history.

(56) References Cited

U.S. PATENT DOCUMENTS

2004/0257314 A1* 12/2004 Chang ..... G09G 3/3241 345/82
2006/0001499 A1* 1/2006 Tatsumi ..... G09G 3/22 332/103

(Continued)

FOREIGN PATENT DOCUMENTS

CN 203242312 U 10/2013

*Primary Examiner* — Larry Sternbane
*Assistant Examiner* — Robert Michaud
(74) *Attorney, Agent, or Firm* — Andrew C. Cheng

(57) ABSTRACT

The present invention provides an array substrate, a display apparatus and a driving method thereof. The array substrate comprises: an active area, comprising a plurality of display pixel units; a source driver, being located outside the active area and providing drive signals to the display pixel units; a gamma voltage generating circuit, providing a gamma reference voltage to the source driver, and the gamma voltage generating circuit is inputted with a PWM signal from the pulse generating circuit TCon and obtains the gamma reference voltage for outputting the gamma reference voltage to the source driver according to the PWM signal. Compared with the programmable control chip, the cost is diminished; compared with the resistance divider, the adjustment is convenient.

5 Claims, 6 Drawing Sheets

(56) References Cited

U.S. PATENT DOCUMENTS

| | | | | |
|---|---|---|---|---|
| 2007/0080905 | A1* | 4/2007 | Takahara | G09G 3/3233 345/76 |
| 2008/0048965 | A1 | 2/2008 | Li | |
| 2008/0122778 | A1* | 5/2008 | Hiraki | G09G 3/3688 345/98 |
| 2014/0168569 | A1* | 6/2014 | Ha | G02F 1/133603 349/61 |

* cited by examiner

ARRAY SUBSTRATE, DISPLAY APPARATUS AND DRIVING METHOD THEREOF

FIELD OF THE INVENTION

The present invention relates to a display apparatus technology field, and more particularly to an array substrate, a display apparatus and a driving method thereof.

BACKGROUND OF THE INVENTION

A TFT-LCD display generally comprises an array substrate, a color filter, and a liquid crystal layer sandwiched in between. The array substrate comprises an active area having pixels arranged in array, and a source driver and a gate driver outside the active area. The source driver and the gate driver are respectively coupled to the respective pixels for driving the pixels to display.

The TFT-LCD display also requires providing a gamma reference voltage to the source driver. At present in the industry, two ways of generating the gamma voltage to the driver circuit in the liquid crystal panel are utilized: one is to utilize the resistance divider, the other is to add a programmable control chip, as the Power IC shown in FIG. 1. As regarding the latter, the source driver is respectively coupled to the pulse generating circuit and the programmable control chip outside the array substrate. The programmable control chip mainly is employed to provide gamma reference voltage for the source driver.

With the first way, i.e. utilizing the resistance divider, the cost is lower but the way of providing the voltage is not flexible and the adjustment is not convenient. With the second way, i.e. the programmable control chip directly supplies the gamma voltage, such way of providing the voltage is flexible but the cost of the programmable control chip is high. Undoubtedly, the programmable control chip will increase the manufacture cost.

SUMMARY OF THE INVENTION

The technical issue to be solved by the present invention is to provide an array substrate, a display apparatus and a driving method thereof the cost is diminished to be compared with the programmable control chip; the adjustment is convenient to be compared with the resistance divider.

For solving the aforesaid technical issue, a technical solution employed by the present invention is: to provide an array substrate, and the array substrate comprises an active area, a source driver, a gamma voltage generating circuit;

the active area, comprising a plurality of display pixel units;

the source driver, being located outside the active area and providing drive signals to the display pixel units;

the gamma voltage generating circuit, providing a gamma reference voltage to the source driver, and the gamma voltage generating circuit is inputted with a PWM signal from the pulse generating circuit TCon and obtains the gamma reference voltage for outputting the gamma reference voltage to the source driver according to the PWM signal;

wherein the array substrate further comprises the pulse generating circuit, coupled to the gamma voltage generating circuit, and the pulse generating circuit comprises a pulse modulation sub circuit, and the gamma voltage generating circuit is coupled to the pulse modulation sub circuit;

wherein the gamma voltage generating circuit comprises a shift register, an OR gate sub circuit, a charging sub circuit, a sampling hold sub circuit which are sequentially coupled, and the shift register is coupled to the charging sub circuit and the sampling hold sub circuit, and a switch is series coupled between the OR gate sub circuit and the charging sub circuit and coupled to a power source, and the sampling hold sub circuit is coupled to the source driver, wherein the shift register specifically expands a series PWM signal into multiple parallel PWM signals, and the sampling hold sub circuit is specifically employed to stable the gamma reference voltage and outputting the gamma reference voltage to the source driver, wherein a connection between the gamma voltage generating circuit and the source driver is replaced with a thin film transistor on the array substrate or printed on the array substrate.

The sampling hold sub circuit empties the gamma reference voltage provided to the source driver when the gamma reference voltage is reset.

The switch further comprises a thin film transistor.

For solving the aforesaid technical issue, another technical solution employed by the present invention is: to provide display apparatus, and the display apparatus comprises:

a pulse generating circuit and an array substrate, and the array substrate comprises an active area, comprising a plurality of display pixel units; a source driver, being located outside the active area and providing drive signals to the display pixel units; a gamma voltage generating circuit, providing a gamma reference voltage to the source driver, wherein the pulse generating circuit is respectively coupled to the source driver and the gamma voltage generating circuit, and the gamma voltage generating circuit is inputted with a PWM signal from the pulse generating circuit and obtains the gamma reference voltage for outputting the gamma reference voltage to the source driver according to the PWM signal.

For solving the aforesaid technical issue, another technical solution employed by the present invention is: to provide a driving method, comprising steps of:

obtaining a PWM signal from a pulse generating circuit;

obtaining a gamma reference voltage according to the PWM signal;

outputting the gamma reference voltage to a source driver for driving source drivers to display.

The step of obtaining the gamma reference voltage comprises:

expanding a series PWM signal into multiple parallel PWM signals;

integrating the parallel PWM signals as PWM signals having various widths;

employing the PWM signals having various widths as control signals for charging and discharging a capacitor of providing the gamma reference voltage, and charging the capacitor when the control signals are at high voltage level, and stopping charging when the control signals are at low voltage level, wherein making a charge quantity of the capacitor to zero before recharging the capacitor next time to ensure the charging is not accumulated;

stabling the gamma reference voltage to be outputted to the source driver.

The step of obtaining the gamma reference voltage further comprising a step of emptying the gamma reference voltage provided to the source driver when the gamma reference voltage is reset.

The benefits of the present invention are: the array substrate provide by the present invention basically integrates the gamma voltage generating circuit inside. A portion or all of the gamma voltage generating circuit and other elements of the array substrate are manufactured at the same time during the array process. The process cost and material cost do not increase much actually, and the cost is enormously decreased than manufacturing a Power IC independently; compared with the resistance divider, it is more difficult for the computer to control the resistance converter if the adjustable resistor is utilized. Besides, the adjustable resistor may have the remained unstable issue of simulation circuit, and the resistance cannot be convenient for adjustment according to the resistance confirmed by the production type and the voltage divided from the resistor. The present invention generates the PWM signals as control signals to provide the gamma reference voltage to the source driver via the power source. No restrictions present cause of the device type and the adjustment is more convenient.

DETAILED DESCRIPTION OF PREFERRED EMBODIMENTS

Hereinafter, the present invention in conjunction with the accompanying drawings and the embodiments is described in detail.

Figure 1:
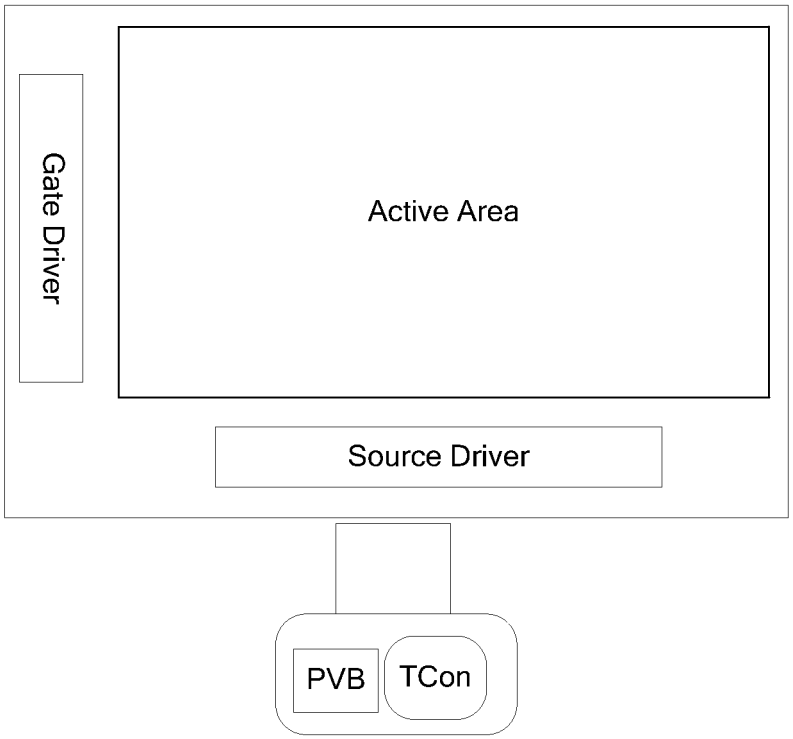
FIG. 1 is a structural diagram of providing a gamma voltage by a programmable control chip a according to prior arts.
Figure 2:
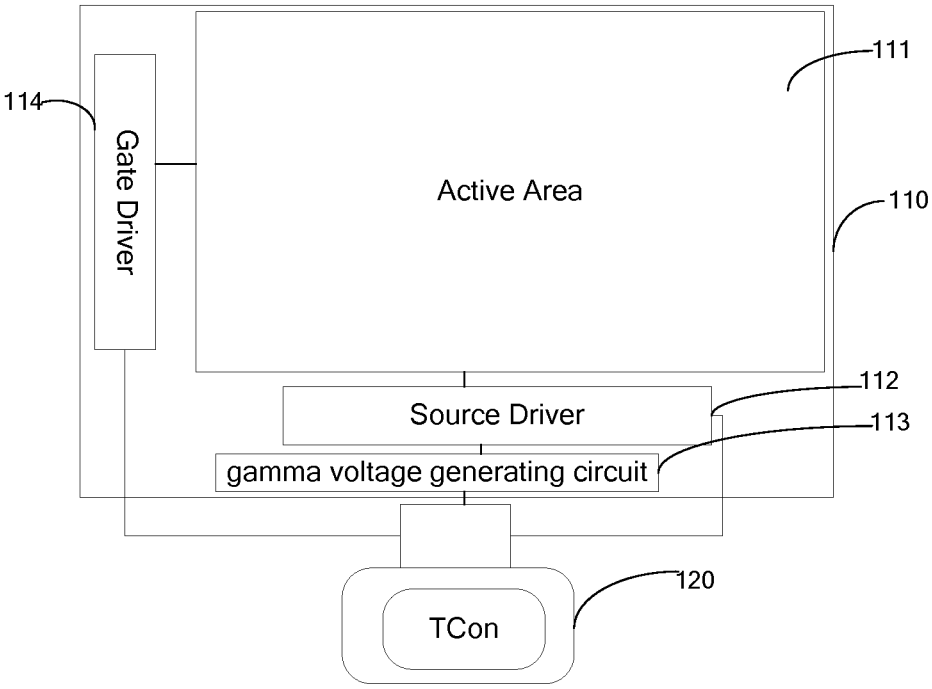
FIG. 2 is a structural diagram of one embodiment of a display apparatus according to the present invention.

Please refer to FIG. 2. FIG. 2 is a structural diagram of one embodiment of a display apparatus according to the present invention. The display apparatus comprises an array substrate 110 and a pulse generating circuit 120.

The array substrate 110 comprises an active area 111, a source driver 112 and a gamma voltage generating circuit 113.

The active area 111 comprises a plurality of display pixel units arranged in array (not shown), employed to show images according to the drive signals of the gate driver 114 and the source driver 112.

The source driver 112 is employed to provide drive signals to the display pixel units in the active area 111.

The gamma voltage generating circuit 113 is employed to be inputted with a PWM signal generated by a pulse generating circuit 114 and control on and off of the switch according to the PWM signals. When the switch is on, the capacitor of providing the gamma reference voltage to the source driver is charged via Vcc. When the switch is off, the charging is stopped and the gamma reference voltage provided to the source driver 112 is obtained.

The pulse generating circuit 120 is employed to generate pulse drive signals, respectively driving the gate driver 114, the source driver 112 and providing the PWM signal to the gamma voltage generating circuit 113.

Different from the condition of prior art, the embodiment integrates the gamma voltage generating circuit inside the array substrate and basically no additional control chip is required. Compared with the expensive programmable control chip, the cost is diminished. Moreover, multiple data lines are essential for the programmable control chip to connect the substrate but the present invention only needs one data line for outputting the PWM signal. A connection between the gamma voltage generating circuit and the source driver is replaced with a thin film transistor on the array substrate or printed on the array substrate without extra loading for the array substrate. Accordingly, the amount of the required data lines between the pulse generating circuit and the substrate; compared with the resistance divider, it is more difficult for the computer to control the resistance converter if the adjustable resistor is utilized. Besides, the adjustable resistor may have the remained unstable issue of simulation circuit, and the resistance cannot be convenient for adjustment according to the resistance confirmed by the production type and the voltage divided from the resistor. The present invention generates the PWM signals as control signals to provide the gamma reference voltage to the source driver via the power source. No restrictions present cause of the device type and the adjustment is more convenient.

Figure 3:
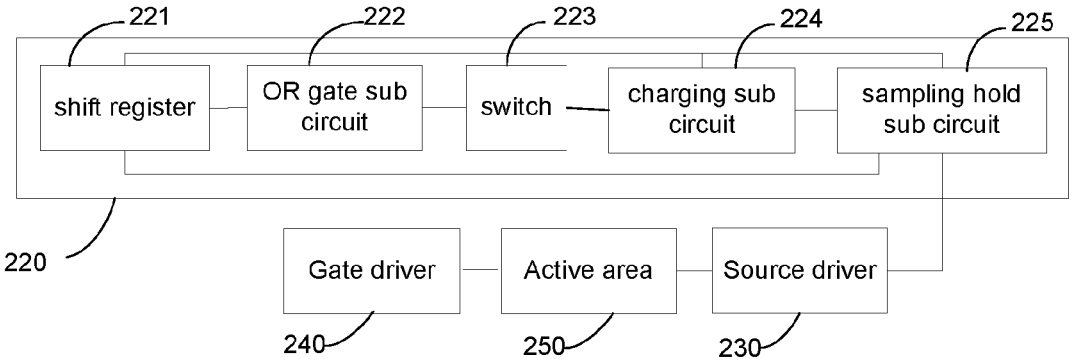
FIG. 3 is a circuit diagram of one embodiment of an array substrate according to the present invention.

Please refer to FIG. 3. FIG. 3 is a circuit diagram of one embodiment of an array substrate according to the present invention. The array substrate can be the array substrate 110 in the display apparatus shown in FIG. 2. The array substrate comprises a gamma voltage generating circuit 220, a source driver 230, a gate driver 240 and an active area 250.

The gamma voltage generating circuit 220 comprises a shift register 221, an OR gate sub circuit 222, a switch 223, a charging sub circuit 224 and a sampling hold sub circuit 225.

The shift register 221 is employed to receive the PWM signal generated by the pulse generating circuit 210 and expands the PWM signal into multiple parallel PWM signals.

Figure 7:
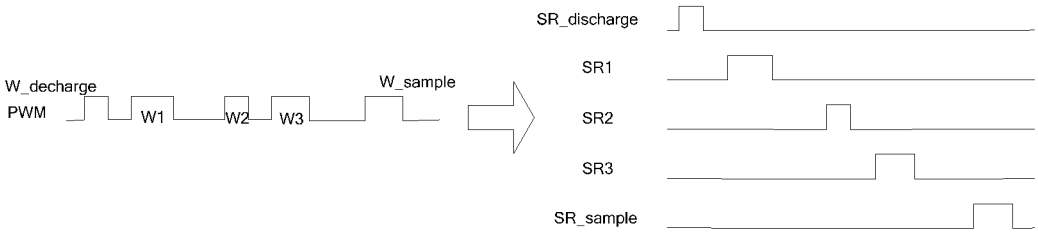
FIG. 7 is a voltage waveform diagram showing a PWM signal passing through a shift register in one embodiment of the driving method according to the present invention.

For instance, the pulse generating circuit 210 generates a PWM signal having five pulse signals in a cycle. Please refer to FIG. 7 at the same time. FIG. 7 is a voltage waveform diagram showing a PWM signal passing through a shift register in one embodiment of the driving method according to the present invention. The shift register 221 receives a series W_discharge, W1, W2, W3, W_sample signal generated by the pulse generating circuit 210 and expands the series PWM signal into multiple parallel SR_discharge, SR1, SR 2, SR 3, SR_sample signals. The SR_discharge signal is transmitted to the charging sub circuit 224 and the sampling hold sub circuit 225. The SR_sample signal is transmitted to the sampling hold sub circuit 225. The SR1, SR 2, SR 3 signals are transmitted to the OR gate sub circuit 222.

The OR gate sub circuit 222 is employed to receive the parallel SR1, SR 2, SR 3 signals and integrates the three parallel PWM signals as PWM signals having various widths.

Figure 8:
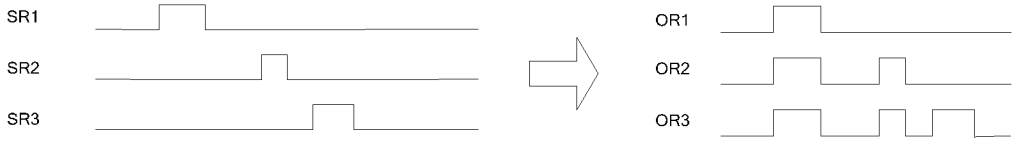
FIG. 8 is a voltage waveform diagram showing a PWM signal passing through an OR gate sub circuit in one embodiment of the driving method according to the present invention.

For instance, three PWM signals in the aforesaid five parallel PWM signals are integrated as three PWM signals having various widths. Please refer to FIG. 8. FIG. 8 is a voltage waveform diagram showing a PWM signal passing through an OR gate sub circuit in one embodiment of the driving method according to the present invention. The OR gate sub circuit 222 integrates the SR1, SR 2, SR3 signals in the multiple parallel PWM signals as OR1, OR2, OR3 signals having various widths and transmits them to the switch 223. The switch 223 comprises a thin film transistor or other equivalent elements. The switch 223 is respectively coupled to the OR gate sub circuit 222, Vcc (not shown) and charging sub circuit 224.

The on and off of the switch 223 is controlled according to the PWM signals to control the conductions of the voltage and the current.

In the specific embodiments, the switch 223 is a thin film transistor or other equivalent elements. The on and off of the switch 223 is controlled according to the PWM signals having various widths. When the PWM signals are at high voltage level, the switch 223 is on. When the PWM signals are at low voltage level, the switch 223 is off.

Figure 9:
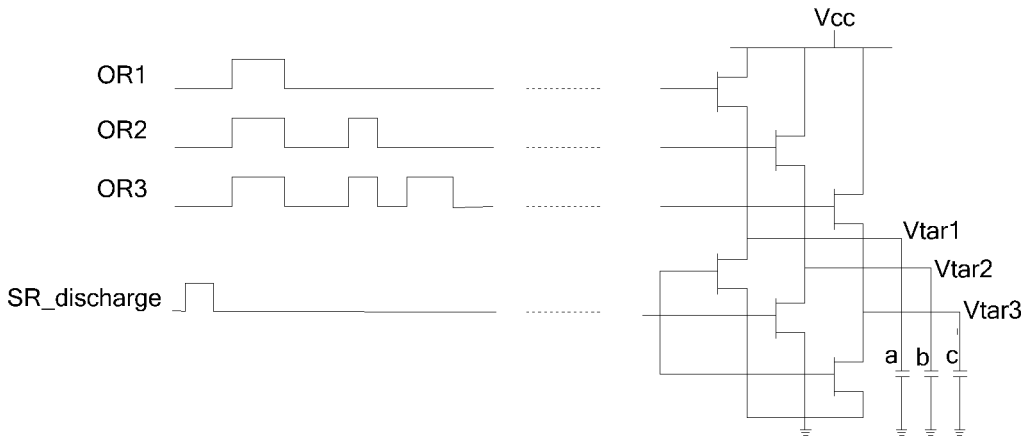
FIG. 9 is a voltage waveform diagram showing a PWM signal passing through a charging sub circuit in one embodiment of the driving method according to the present invention.
Figure 11:
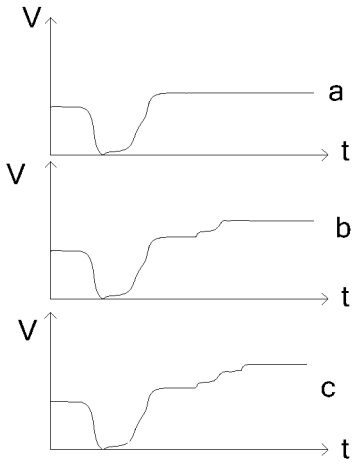
FIG. 11 is a voltage waveform diagram showing a PWM signal passing through a charging sub circuit in one embodiment of the driving method according to the present invention.

The charging sub circuit 224 is employed to charge and discharge a capacitor of providing the gamma reference voltage according to the on and off of the switch 223. Please refer to FIG. 9. FIG. 9 is a voltage waveform diagram showing a PWM signal passing through a charging sub circuit in one embodiment of the driving method according to the present invention. When the switch is on, the capacitor is charged via Vcc. When the switch is off, the charging is stopped; before recharging the capacitor next time, the discharging signal SR_discharge of the PWM signals passing through the shift register 221 is employed to make a charge quantity of the capacitor to zero to ensure the charging is not accumulated. Meanwhile, please refer to FIG. 11. FIG. 11 is a voltage waveform diagram showing a PWM signal passing through a charging sub circuit in one embodiment of the driving method according to the present invention.

Figure 10:
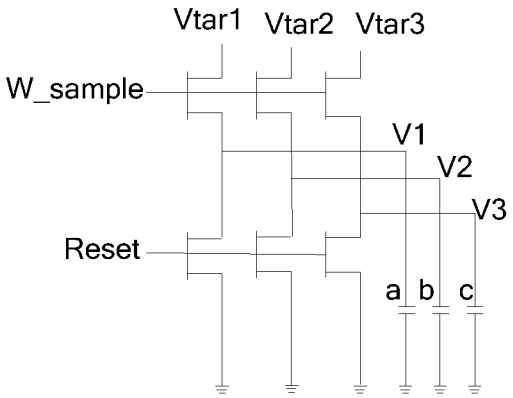
FIG. 10 is a voltage waveform diagram showing a PWM signal passing through a sampling hold sub circuit in one embodiment of the driving method according to the present invention.
Figure 12:
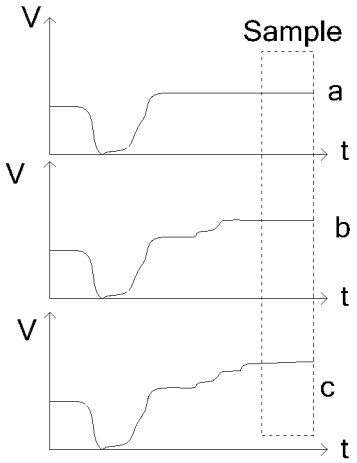
FIG. 12 is a voltage waveform diagram showing a PWM signal passing through a charging sub circuit and a sampling hold sub circuit in one embodiment of the driving method according to the present invention.

The sampling hold sub circuit 225 is employed to prevent the gamma reference voltage error of the capacitor as charging. The sampling hold sub circuit 225 is to stable the gamma reference voltage of the capacitor and outputs the stable voltage to the source driver 230. Please refer to FIG. 10. FIG. 10 is a voltage waveform diagram showing a PWM signal passing through a sampling hold sub circuit in one embodiment of the driving method according to the present invention. After the last PMW signal having the effective width W3, the W_sample signal is sent out. At this moment, the voltage Vtar is employed to charge the capacitor to keep the voltage outputted to the source driver 230 stable. The Reset signal (discharge signal) is employed to empty the storage voltage of the capacitor. The capacitor needs to be emptied when the gamma reference voltage is reset. Meanwhile, please refer to FIG. 12. FIG. 12 is a voltage waveform diagram showing a PWM signal passing through a charging sub circuit and a sampling hold sub circuit in one embodiment of the driving method according to the present invention.

The source driver 230 is employed to receive the gamma reference voltage generated by the gamma voltage generating circuit 220 and the control signals of the pulse generating circuit 210. According to the received control signals, the active area 230 is drove to show corresponding images.

The gate driver 240 is employed to provide gate drive signals for driving the active area 250.

The active area 230 shows corresponding images according to the drive signals of the gate driver 240 and the source driver 230.

Figure 4:
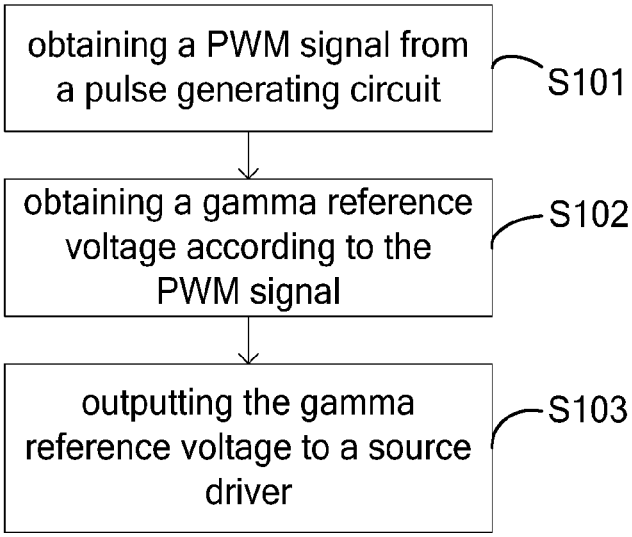
FIG. 4 is a flowchart of one embodiment of a driving method according to the present invention.

Please refer to FIG. 4. FIG. 4 is a flowchart of one embodiment of a driving method according to the present invention. The present invention provides a driving method, comprising steps of:

S101, obtaining a PWM signal from a pulse generating circuit.

The drive system of the flat panel display generally comprises a gate driver and a source driver. The gate driver is in charge of turning on or turning off some pixels. The source driver is in charge of providing voltage signal for the pixels when the pixel is turned on. The gate driver and the source driver are controlled by signals generated by TCon. However, the voltage of the control signals generated by the TCon is not enough and an additional reference voltage is required. The PWM signal is generated by the pulse generating circuit. The pulse generating circuit can be a PWM signal generating sub circuit or other equivalent circuit in the TCon.

S102, obtaining a gamma reference voltage according to the PWM signal.

The on and off of the switch is controlled according to the PWM signal obtained in the step S101. The capacitor of providing the gamma reference voltage to the data generating circuit is charged via the power source. When the PWM signal is at high level voltage and the switch is on, the capacitor is charged via Vcc. When the PWM signal is at low level voltage and the switch is off, the charging is stopped; before recharging the capacitor next time, the discharging signal is employed to make a charge quantity of the capacitor to zero to ensure the charging is not accumulated. Accordingly, the gamma reference voltage is obtained.

S103, outputting the gamma reference voltage to a source driver.

The gamma reference voltage is outputted to the source driver. The source driver converts the drive signals and outputs them to the active area according to the received signal.

The active area shows corresponding images according to the received gate driver signals and the drive signals of the source driver.

Figure 5:
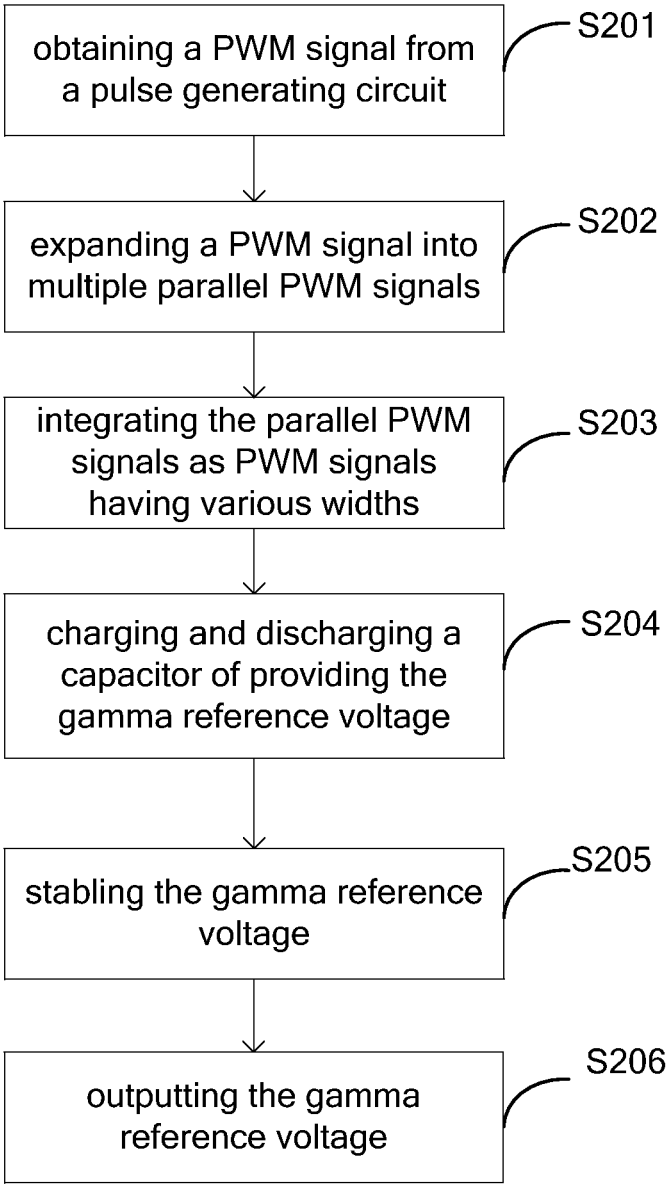
FIG. 5 is a flowchart of another embodiment of a driving method according to the present invention.

Please refer to FIG. 5. FIG. 5 is a flowchart of another embodiment of a driving method according to the present invention. The present invention provides a driving method, comprising steps of:

S201, obtaining a PWM signal from a pulse generating circuit.

The PWM signal is generated by the pulse generating circuit, and proceeding step S202.

S202, expanding a PWM signal into multiple parallel PWM signals.

The PWM signal outputted from the pulse generating circuit is expanded into multiple parallel PWM signals via the shift register. If the PWM signal outputted from the pulse generating circuit has five pulse signals. The shift register expands it into five parallel PWM signals, and proceeding to the step S203.

S203, integrating the PWM signals as PWM signals having various widths.

Three PWM signals in the aforesaid five parallel PWM signals, which have been processed in the step S202 are integrated as three PWM signals having various widths via the OR gate sub circuit. Please refer to FIG. 8. FIG. 8 is a voltage waveform diagram showing a PWM signal passing through an OR gate sub circuit in one embodiment of the driving method according to the present invention. The SR1, SR 2, SR3 signals in the multiple parallel PWM signals after the step S202 are integrated into OR1, OR2, OR3 signals having various widths and then transmitted to the switch 223. The switch 223 comprises a thin film transistor or other equivalent elements. The switch 223 is respectively coupled to the OR gate sub circuit 222, Vcc (not shown) and charging sub circuit 224.

S204, charging and discharging a capacitor of providing the gamma reference voltage.

The on and off of the switch is controlled according to the PWM signal processed in the step S203. When the PWM signal is at high level voltage, the capacitor is charged via Vcc. When the PWM signal is at low level voltage and the switch is off, the charging is stopped; before recharging the capacitor next time, the discharging signal is employed to make a charge quantity of the capacitor to zero to ensure the charging is not accumulated, and proceeding to the step S205.

S205, stabling the gamma reference voltage.

For preventing the gamma reference voltage error as charging. The sampling hold sub circuit 225 is employed to stable the gamma reference voltage and the discharging signal of the PWM signals in the step S204 is employed to empty the storage voltage of the capacitor of providing the gamma reference voltage for the source driver, and proceeding to the step S206.

S206, outputting the gamma reference voltage.

The stable gamma reference voltage is outputted to the source driver.

Hereafter, one complete cycle is illustrated for further explanation to the driving method of the present invention. The PWM signal comprising five pulse signals in one cycle is illustrated.

Figure 6:
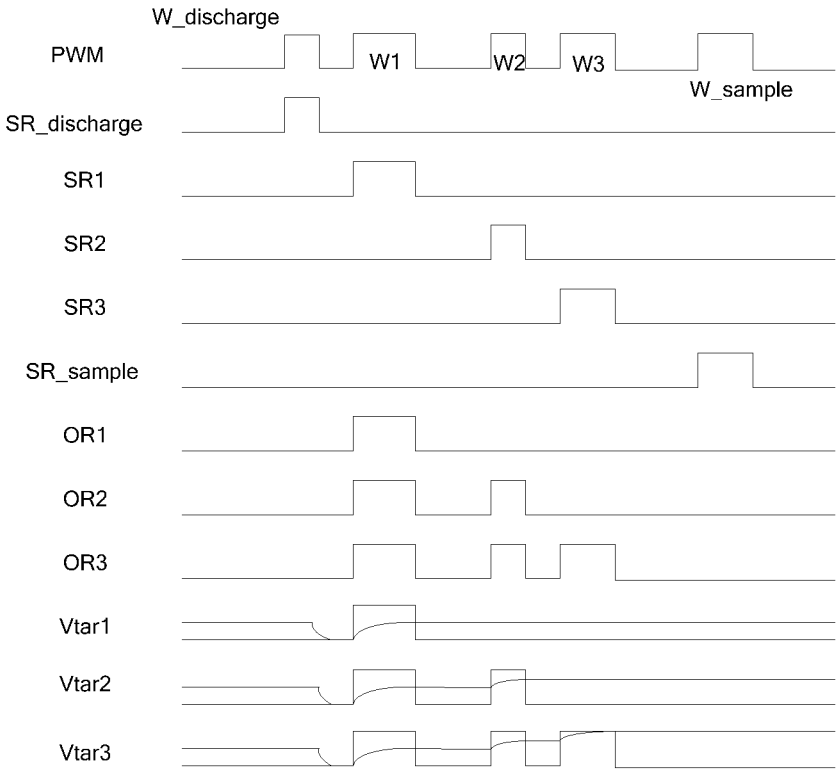
FIG. 6 is a voltage waveform diagram showing one complete cycle of a PWM signal in one embodiment of the driving method according to the present invention.

Please refer to FIG. 6. FIG. 6 is a voltage waveform diagram showing one complete cycle of a PWM signal in one embodiment of the driving method according to the present invention.

The pulse generating circuit generates a PWM signal having W_discharge, W1, W2, W3, W_sample signals. The W1, W2, W3 signals are transmitted to the shift register and converted into parallel SR_discharge, SR1, SR2, SR3, SR_sample signals. The SR_discharge signal is transmitted to the charging sub circuit and the sampling hold sub circuit. The SR_sample signal is transmitted to the sampling hold sub circuit. SR1, SR 2, SR 3 signals are converted into OR1, OR2, OR3 signals via the OR gate sub circuit. The OR1, OR2, OR3 signals are employed to control the on and off of the thin film transistor. When the OR1, OR2, OR3 signals are at high voltage level, the capacitor of providing the gamma reference voltage to the source driver is charged via Vcc. When they are at low voltage level, the charging to the capacitor is stopped.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An array substrate, wherein the array substrate comprises:

an active area, comprising a plurality of display pixel units;

a source driver, being located outside the active area and providing drive signals to the display pixel units;

a gamma voltage generating circuit, providing a gamma reference voltage to the source driver, and the gamma voltage generating circuit is inputted with a PWM signal from the pulse generating circuit TCon and obtains the gamma reference voltage for outputting the gamma reference voltage to the source driver according to the PWM signal;

wherein the array substrate further comprises the pulse generating circuit, coupled to the gamma voltage generating circuit, and the pulse generating circuit comprises a pulse modulation sub circuit, and the gamma voltage generating circuit is coupled to the pulse modulation sub circuit;

wherein the gamma voltage generating circuit comprises a shift register, an OR gate sub circuit, a charging sub circuit, a sampling hold sub circuit which are sequentially coupled, in series; the shift register is additionally coupled to the charging sub circuit and the sampling hold sub circuit; a switch is coupled, in series, between the OR gate sub circuit and the charging sub circuit and is also coupled to a power source; and the sampling hold sub circuit is coupled to the source driver, wherein the shift register expands a series PWM signal into multiple parallel PWM signals, and the sampling hold sub circuit stabilizes the gamma reference voltage and outputs the gamma reference voltage to the source driver, wherein the gamma voltage generating circuit is connected to the source driver through one of a thin film transistor on the array substrate and a connection pattern printed on the array substrate; and wherein the charging sub circuit comprises a plurality of capacitors and the multiple parallel PWM signals are integrated to provide a plurality of control signals of various widths respectively corresponding to the plurality of capacitors, the control signals being applied to control selective charging of the plurality of capacitors, respectively, such that the plurality of capacitors are respectively charged to different levels of potential.

2. The array substrate according to claim 1, wherein the sampling hold sub circuit clears the gamma reference voltage that is provided from the gamma voltage generating circuit to the source driver when the gamma reference voltage is reset.

3. The array substrate according to claim 1, wherein the switch further comprises a thin film transistor.

4. A display apparatus, wherein the display apparatus comprises a pulse generating circuit and an array substrate, and the array substrate comprises an active area, comprising a plurality of display pixel units; a source driver, being located outside the active area and providing drive signals to the display pixel units; a gamma voltage generating circuit, providing a gamma reference voltage to the source driver, wherein the pulse generating circuit is respectively coupled to the source driver and the gamma voltage generating circuit, and the gamma voltage generating circuit is inputted with a PWM signal from the pulse generating circuit and obtains the gamma reference voltage for outputting the gamma reference voltage to the source driver according to the PWM signal;

wherein the array substrate further comprises the pulse generating circuit, coupled to the gamma voltage generating circuit, and the pulse generating circuit comprises a pulse modulation sub circuit, and the gamma voltage generating circuit is coupled to the pulse modulation sub circuit;

wherein the gamma voltage generating circuit comprises a shift register, and OR gate sub circuit, a charging sub circuit, and a sampling hold sub circuit, which are sequentially coupled in series; the shift register is additionally coupled to the charging sub circuit and the sampling hold sub circuit; a switch is coupled, in series, between the OR gate sub circuit and the charging sub circuit and is also coupled to a power source; and the sampling hold sub circuit is coupled to the source driver, wherein the shift register expands a series PWM signal into multiple parallel PWM signals, and the sampling hold sub circuit stabilizes the gamma reference voltage and outputs the gamma reference voltage to the source driver, wherein the gamma voltage generating circuit is connected to the source driver through one of a thin film transistor on the array substrate and a connection pattern printed on the array substrate; and wherein the charging sub circuit comprises a plurality of capacitors and the multiple parallel PWM signals are integrated to provided a plurality of control signal of various widths respectively corresponding to the plurality of capacitors, the control signals being applied to control selective charging of the plurality of capacitors, respectively, such that the plurality of capacitors are respectively charges to different levels of potential.

5. A driving method, comprising steps of:

obtaining a PWM signal from a pulse generating circuit;

obtaining a gamma reference voltage according to the PWM signal;

outputting the gamma reference voltage to a source driver for driving a display to display an image;

wherein the step of obtaining the gamma reference voltage comprises:

expanding a series PWM signal into multiple parallel PWM signals;

integrating the parallel PWM signals as PWM signals having various widths;

employing the PWM signals having various widths as control signals for charging and discharging a plurality of capacitors to provide the gamma reference voltage, wherein the plurality of capacitors are charged when the control signals are at a high voltage level such that the plurality of capacitors are respectively charged to different levels of potential, and charging is stopped when the control signals are at a low voltage level, and wherein making a charge quantity of the plurality of capacitors to zero before recharging the plurality of capacitors next time to ensure charging is not accumulated;

stabilizing the gamma reference voltage to be outputted to the source driver; and wherein the step of obtaining the gamma reference voltage further comprising a step of clearing the gamma reference voltage provided to the source driver when the gamma reference voltage is reset.

* * * * *